US005308942A

United States Patent [19]

Mercurio

[11] Patent Number: 5,308,942

[45] Date of Patent: May 3, 1994

[54] SWITCH CONSTRUCTION FOR COIN OPERATED MACHINES

[75] Inventor: Leonard Mercurio, Dix Hills, N.Y.

[73] Assignee: Set-O-Matic, Inc., Farmingdale, N.Y.

[21] Appl. No.: 909,073

[22] Filed: Jul. 2, 1992

[51] Int. Cl.[5] ..... H01H 9/02

[52] U.S. Cl. ..... 200/332.1; 200/295; 200/61.72; 200/DIG. 3

[58] Field of Search ..... 200/295, 342, 330, 332.1, 200/339, 61.67, 61.72, 61.81, DIG. 3

[56] References Cited

U.S. PATENT DOCUMENTS

| | | | |
|---|---|---|---|
| 2,803,718 | 8/1957 | Bloom et al. | 200/332.1 |
| 3,569,655 | 3/1971 | Jakubauskas | 200/330 |
| 4,477,702 | 10/1984 | Goldhammer | 200/332.1 |

OTHER PUBLICATIONS

T. A. Lasky, *Resilient Switch Block*, May 1979, IBM Technical Disclosure Bulletin, vol. 21, No. 12, p. 4958.

*Primary Examiner*—Renee S. Luebke

*Attorney, Agent, or Firm*—Charles E. Temko

[57] ABSTRACT

A toggle switch construction operating in conjunction with a conventional coin slide acceptor to produce a single signal each time the coin slide is reciprocated. The switch is mounted upon a support member, which, in turn, is mounted for limited pivotal movement during actuation by a member on the coin slide such that the member, after actuating the switch passes over the toggle. On the return movement of the coin slide to its initial position, the toggle is re-engaged and returned to its initial position, following which the member again passes over the toggle. The toggle can therefore be cycled only once for each reciprocation of the coin slide.

2 Claims, 4 Drawing Sheets 37
58
53
54
44
45
46
49
50
41
15
57
43
56
55
47
40
12
48

SWITCH CONSTRUCTION FOR COIN OPERATED MACHINES

BACKGROUND OF THE INVENTION

This invention relates generally to the field of coin operated machines which either vend an article of merchandise or provide a service in response to the depositing of coins by a user using a so-called coin slide, and more particularly to an improved switch construction which is operated in response to the reciprocating movement of such coin slides.

Particularly in the case of commercially operated laundrying machines including both washers and dryers which commence a cycle of operation with the completion of one or more such coin slide reciprocations, it has become increasingly necessary to monitor each such reciprocation either electronically or electro-mechanically to prevent the fraudulant use of the machine by obtaining more cyles of operations than had been paid for. Such use is often possible for the reason that the inner end of the coin slide commonly used to initiate a cycle by a mechanical tripping function has in large measure been replaced by using the same movement to close an electrical switch connected to the electronic circuitry which controls the operation of the machine. Most coin slide mechanisms are provided with a ratchet and pawl which comes into operation when the coin slide has been advanced sufficiently to allow deposited coins to fall into a coin receiving receptacle, the ratchet usually having teeth engaged by the pawl which are spaced a distance of approximately one-quarter of an inch. The last tooth on the ratchet is in engagement when the inner end of the coin slide is in position to close a switch which provides a signal input to the circuitry which, inter alia commences an operational cycle, after which the ratchet disengages to permit return of the slide under the action of a spring to its original position.

However, while the last tooth on the ratchet is engaged, it is possible to move the slide over a short path of travel approximating one-quarter inch without disengaging the ratchet, and if the slide is advanced cautiously, it is possible for an unscrupulous user to trip the initiating switch without releasing the last tooth on the ratchet. A cycle can then be initiated on a repeating basis by merely allowing the slide to remain engaged with the last tooth on the ratchet during an operational cycle, and commence a new cycle when needed thereafter by merely again advancing the slide only sufficiently to again trip the switch.

This problem is not resolved by providing a toggle type switch in place of a normally open switch wherein the toggle is operated by selective contact with two separate points on the coin slide. If the above procedure is followed, the toggle switch can be allowed to remain in closed condition, and recycling is commenced automatically, the user controlling operations by manually opening and closing the door of the machine.

SUMMARY OF THE INVENTION

Briefly stated, the invention contemplates the provision of improved structure in devices of the type described, in which the above mentioned problem is substantially resolved. To this end, the switch employed to commence operation of the machine is of toggle type known in the art, and which is mounted upon a link which, in turn, is pivotedly mounted about an axis perpendicular to the axis of movement of the coin slide. The link may be mounted upon a housing which supports the coin box, or directly upon the coin slide element itself. The distal end of the slide mounts a switch toggle engaging member which upon inward movement of the coin slide first pivots the link while substantially simultaneously tripping the toggle switch, and then passes over the end of the toggle as the toggle is displaced by pivotal movement of the link upon which it is mounted. The link is resiliently returned to its initial position, so that upon return movement of the slide, the toggle engaging member again contacts the toggle to open the switch prior to again passing over the toggle in a reverse direction, at which time the link again returns to its initial position for the initiation of a subsequent cycle. Because the resilient force transmitted to the link is relatively small when the link is in its initial position, it will pivot to a substantial degree before the switch is tripped or closed, requiring a degree of movement of the slide substantially greater than the above mentioned one quarter inch, following which the ratchet is released for the return movement of the slide. This requirement effectively prevents the bypassing of the ratchet action which is necessary to provide for the unauthorized procedure described above. Once the ratchet is released, as the toggle engaging member again contacts the toggle it returns the switch to open condition which action must occur before another cycle is commenced.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
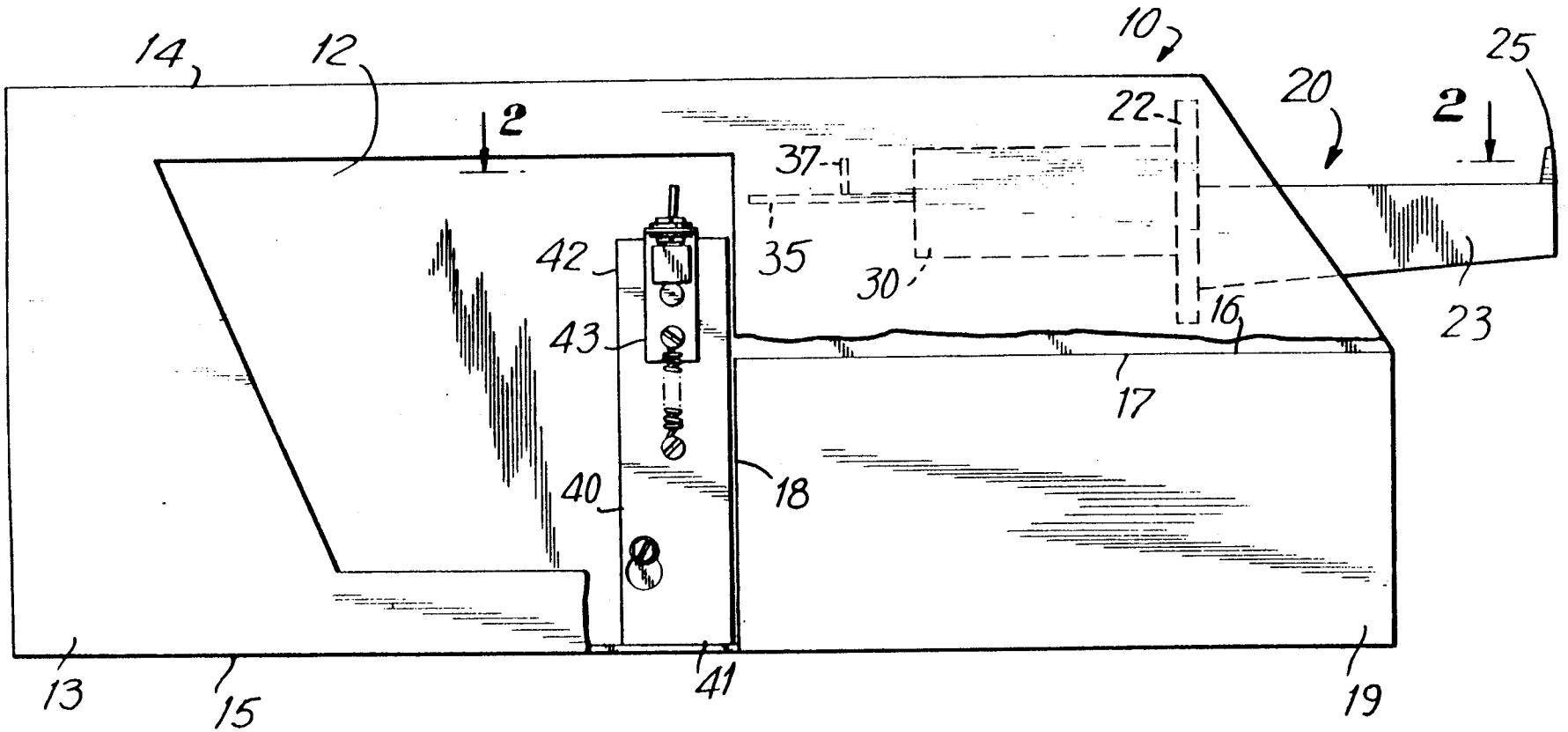
FIG. 1 is a side elevational view, partly broken away for purposes of clarity of a coin collection box element of a coin operated device embodying the invention.
Figure 2:
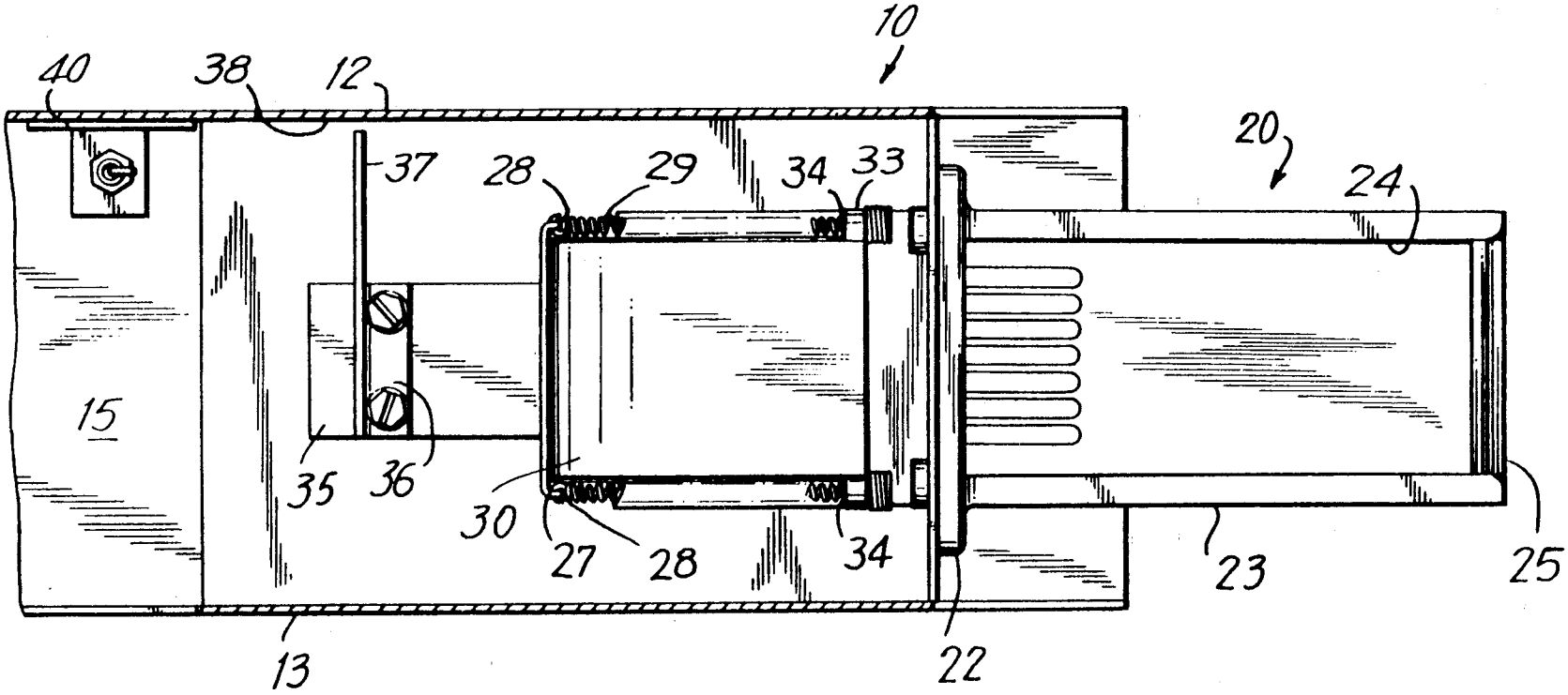
FIG. 2 is a horizontal sectional view thereof as scene from the plain 2—2 in FIG. 1.

In accordance with the invention, reference character 10 designates a conventional coin box element used in conjunction with a laundry machine (not shown), the element 10 including first and second longitudal walls 12 and 13, an upper wall 14, a lower wall 15, and a coin slide element supporting shelf 16 including a horizontal wall 17 and a vertical wall 18 forming a recess for a coin receiving box (not shown) of known type.

Supported upon the wall 17 is a coin slide element of known type, the details of which are outside the scope of the present disclosure. It includes a vertically oriented mounting wall 22 which engages the box element 10, an external slide support member 23 having an elongated channel 24 therein which guides a recipracating coin slide 25. On the opposite side of the wall 22 is an internal coin slide support which mounts a housing 27 including a pair of brackets each engaging one end 28 of a pair of return springs 29, again as known in the art. Disposed within the housing 27 is a known ratchet and pawl which engages after inward movement of the coin slide sufficient to discharge user inserted coins, and which compels completion of inward movement to commence a cycle of operation before permitting return of the coin slide to its initial position.

The coin slide element 20 also includes an upstanding bracket 33 for engaging the opposite ends 34 of the springs 29. On the inner end of the coin slide is a terminal member 35 which is used to mount a variety of actuation members depending upon the construction of the particular device in which the coin slide element is installed. A laterally extending switch toggle engaging member 36 is mounted thereon, a free end 37 thereof being thereby positioned immediately inwardly of the inner surface 38 of the wall 12.

Mounted on the inner surface 38 is a vertically oriented mounting plate 40, a lower end 41 of which abuts the lower wall 15. An upper end 42 mounts an L-shaped link 43 having a horizontally mounted pintle 44 on a vertically oriented member 45. A lower end 46 of this member mounts a terminal 47 engaging the upper end 48 of a coil spring. A lower end 49 of the spring engages a second terminal 50 secured to the plate 40. In FIG. 1, the spring is shown in relatively unstressed condition, with its line of axis passing through the axis of the pintle 44.

Extending laterally from the plane of the vertical member 43 is a horizontal member 53 having an orifice 54 for mounting a miniature toggle switch 55 of known type. The switch includes a main body 56 disposed below the plane of the member 53, a threaded mounting shank 57 which extends through the orifice 54, and a manually engageable toggle 58 which has a pivotal path of travel relative to the main body in the range of 10–15 degrees.

Figures 3, 4, 5:
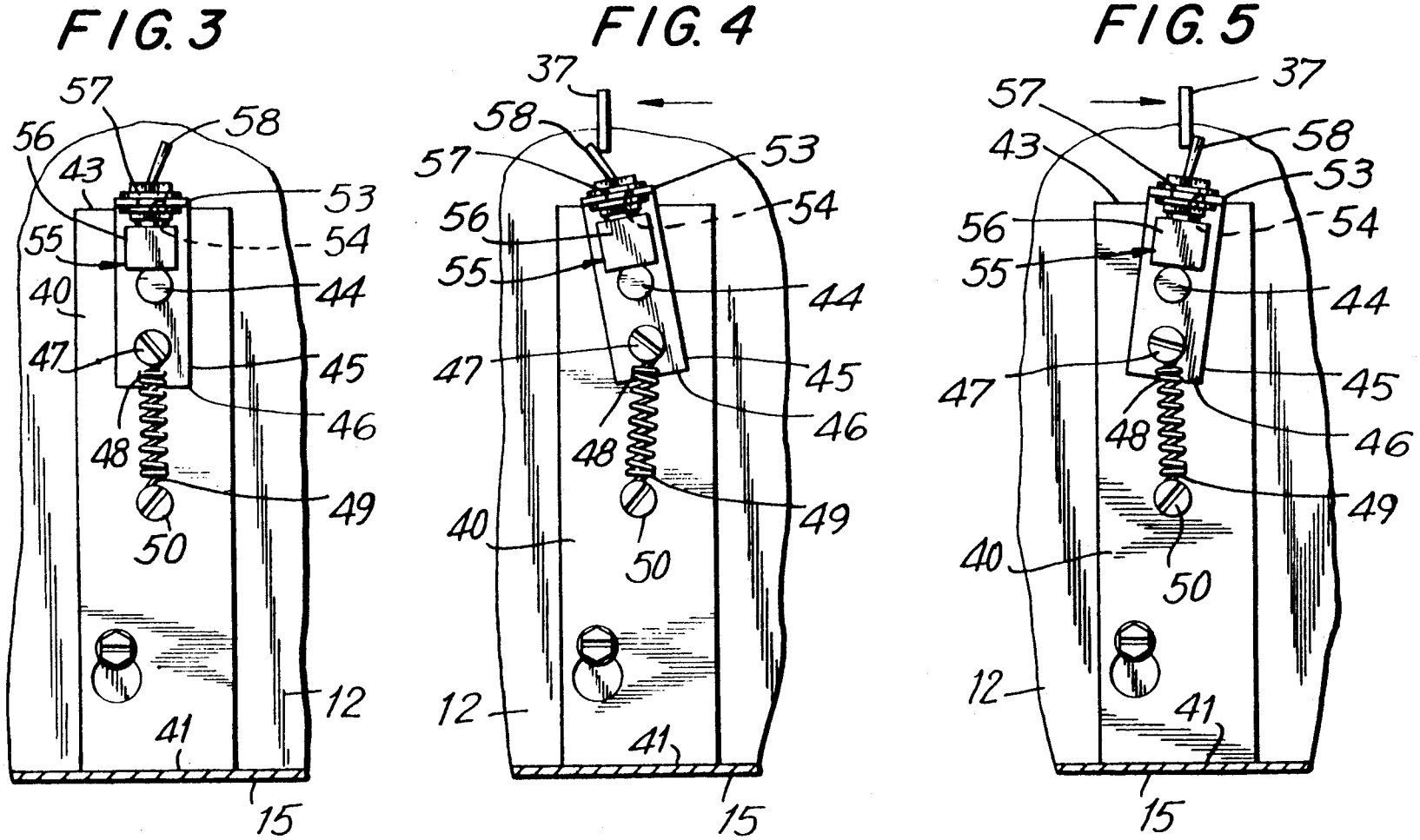
FIG. 3 is an enlarged fragmentary side elevational view showing a pivotally mounted toggle switch forming a part of embodiment.
FIG. 4 is a similar fragmentary side elevational view corresponding to that seen in FIG. 3 with certain of the parts in altered relative position.
FIG. 5 is a similar fragmentary side elevational view showing another relative position of the same parts.

Operation of the device will be evident from a comparison of FIGS. 3, 4 and 5. During normal use, after depositing the requisite number of coins, the coin slide is pushed inwardly to a point where the coins are released from the slide and allowed to drop into the coin box. At this point, in a manner known in the art, the ratchet and pawl mechanism becomes engaged requiring further inward movement of the coin slide to commence an operational cycle before the coin slide is permitted to return to its initial position. Near the end of this movement, the toggle engaging member 36 contacts the toggle 58 and, with continued movement rides thereover. During this movement, the link 43 is first pivoted away from its initial position, and as resistance to further pivotal movement of the link accumulates, this resistance exceeds the force necessary to trip the toggle, thereby closing the switch 55 and initiating the operational cycle. Because of the extent of movement required to first pivotally move the link 43 and trip the switch, this movement will normally exceed the usual one-quarter inch of play permissible by the relative spacing of the teeth on the ratchet.

Once the ratchet is released, the return springs 29 will urge the coin slide to its initial position. During this movement, the member 36 will again pass the switch 55 which in the mean time has returned to its initial position, so that an identical action occurs in an opposite direction, with the switch returning to open condition. It will be appreciated that given the amount of movement necessary in each direction, it is not possible to trip the switch from open to closed condition more than once during each reciprocation of the coin slide.

Figure 6:
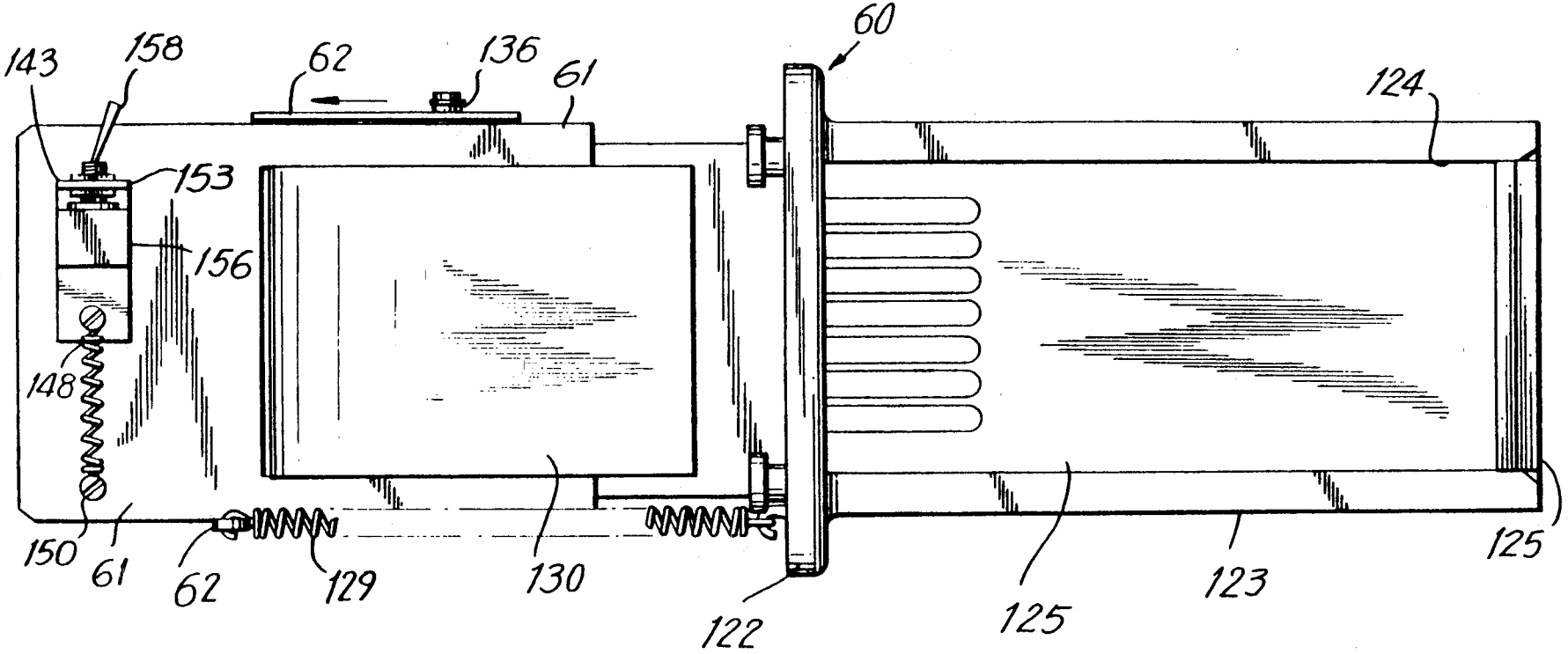
FIG. 6 is a top plan view of a coin slide element forming part of a second embodiment of the invention.

Turning now to the second embodiment of the invention, generally indicated by reference character 60, shown in FIG. 6, parts corresponding to those of the first embodiment have been designated by similar reference characters with the additional prefix "1".

The second embodiment differs from the first embodiment principally in the mounting of the link 143 upon a horizontally oriented plate 61 which is mounted directly upon the coin slide element, rather than mounting the same in a vertical orientation on an inner wall of the coin box element. The plate 61 is stationery. The toggle engaging member 136 is mounted on a vertically oriented portion 62 of a bracket (not shown) secured to the undersurface of the coin slide 125, and moves therewith under the influence of a single return spring 129. This construction is particularly useful when the location of the coin slide element is not immediately adjacent an inner surface of the coin box element.

I wish it to be understood that I do not consider the invention to be limited to the precise details of structure shown and set forth in this specification, for obvious modifications will occur to those skilled in the art to which the invention pertains.

I claim:

1. In a coin operated vending device including a coin collection means having a manually operated coin slot element for initiation of a cycle of operation, said initiation including a closing of an electrical circuit by means of a switch activated by movement of said coin slide, the improvement comprising: a pivotally mounted link fixed for movement about an axis perpendicular to a path of movement of said coin slide, said switch including an exposed toggle member, said coin slide having a toggle engaging member thereon positioned to contact and displace said toggle member during movement in first and second opposite directions; said pivotally mounted link having a free end thereon, a resilient member, said resilient member engaging said free end of said link in such manner as to urge said link to an initial rotational position while permitting rotation in either rotational direction from said initial position; whereby, upon initial contact of said toggle engaging member with said toggle member of said switch, said link is pivoted in a first direction to result in displacing said toggle member out of the path of movement of said toggle engaging member as said toggle member is moved to actuate said switch; said link member being mounted upon said coin slide element.

2. In a coin operated vending device including a coin collection means having a manually operated coin slot element for initiation of a cycle of operation, said initiation including a closing of an electrical circuit by means of a switch activated by movement of said coin slide, the improvement comprising: a pivotally mounted link fixed for movement about an axis perpendicular to a path of movement of said coin slide, said switch including an exposed toggle member, said coin slide having a toggle engaging member thereon positioned to contact and displace said toggle member during movement in first and second opposite directions; said pivotally mounted link having a free end thereon, a resilient member, said resilient member engaging said free end of said link in such manner as to urge said link to an initial rotational position while permitting rotation in either rotational direction from said initial position; whereby, upon initial contact of said toggle engaging member with said toggle member of said switch, said link is pivoted in a first direction to result in displacing said toggle member out of the path of movement of said toggle engaging member as said toggle member is moved to actuate said switch; said link member being mounted upon said coin collection means.

* * * * *